US005131453A

United States Patent [19]

Ros Navarro et al.

[11] Patent Number: 5,131,453

[45] Date of Patent: Jul. 21, 1992

[54] MODULAR CONTINUOUS CASTING APPARATUS

[75] Inventors: Carlos Ros Navarro, Alella, Spain; Adrian Stilli, Bülach; Adalbert Roehrig, Thalwill, both of Switzerland

[73] Assignee: Concast Standard AG, Zürich, Switzerland

[21] Appl. No.: 702,148

[22] Filed: May 13, 1991

Related U.S. Application Data

[63] Continuation of Ser. No. 513,805, Apr. 24, 1990, abandoned.

[30] Foreign Application Priority Data

Apr. 24, 1989 [CH] Switzerland ..... 01574/89

[51] Int. Cl.[5] ..... B22D 11/08; B22D 11/00

[52] U.S. Cl. ..... 164/445; 164/425; 164/420

[58] Field of Search ..... 164/425, 426, 445, 446, 164/483, 420

[56] References Cited

U.S. PATENT DOCUMENTS

| | | | |
|---|---|---|---|
| 3,358,743 | 12/1967 | Adams | 164/420 |
| 3,433,287 | 3/1969 | Greenberger | 164/426 |
| 3,628,595 | 12/1971 | Mitchell | 164/426 |
| 4,412,579 | 11/1983 | Zavodszky | 164/426 |
| 4,498,520 | 2/1985 | Colombo | 164/426 |
| 4,561,490 | 12/1985 | Navarro | 164/426 |

FOREIGN PATENT DOCUMENTS

| | | | |
|---|---|---|---|
| 0035088 | 9/1981 | European Pat. Off. | 164/426 |

*Primary Examiner*—Richard K. Seidel
*Assistant Examiner*—Rex E. Pelto
*Attorney, Agent, or Firm*—Peter K. Kontler; Tobias Lewenstein

[57] ABSTRACT

A curved-mold continuous casting apparatus has a reciprocable mold with a curved casting passage and an arm which guides the mold for reciprocation. A secondary cooling unit is located downstream of the mold and is followed by a withdrawal-and-straightening unit. The apparatus further has a rigid, curved dummy bar, a piston-and-cylinder unit for moving the dummy bar between a storage position and a casting position, and a lever which is articulated to the dummy bar and guides the same. A support consisting of a bedplate with an upright stand holds the mold, guide arm, secondary cooling unit, withdrawal-and-straightening unit, dummy bar, piston-and-cylinder unit and lever in assembled condition and in alignment for casting. The support and the components carried thereby form a preassembled, transportable module which can be brought to a casting location or removed from such location. The module may have conduits for fluids such as cooling water, mold lubricant and protective gas, and these conduits are provided with coupling elements which can mate with complementary coupling elements on fluid supply lines when the module is installed at a casting location.

16 Claims, 1 Drawing Sheet

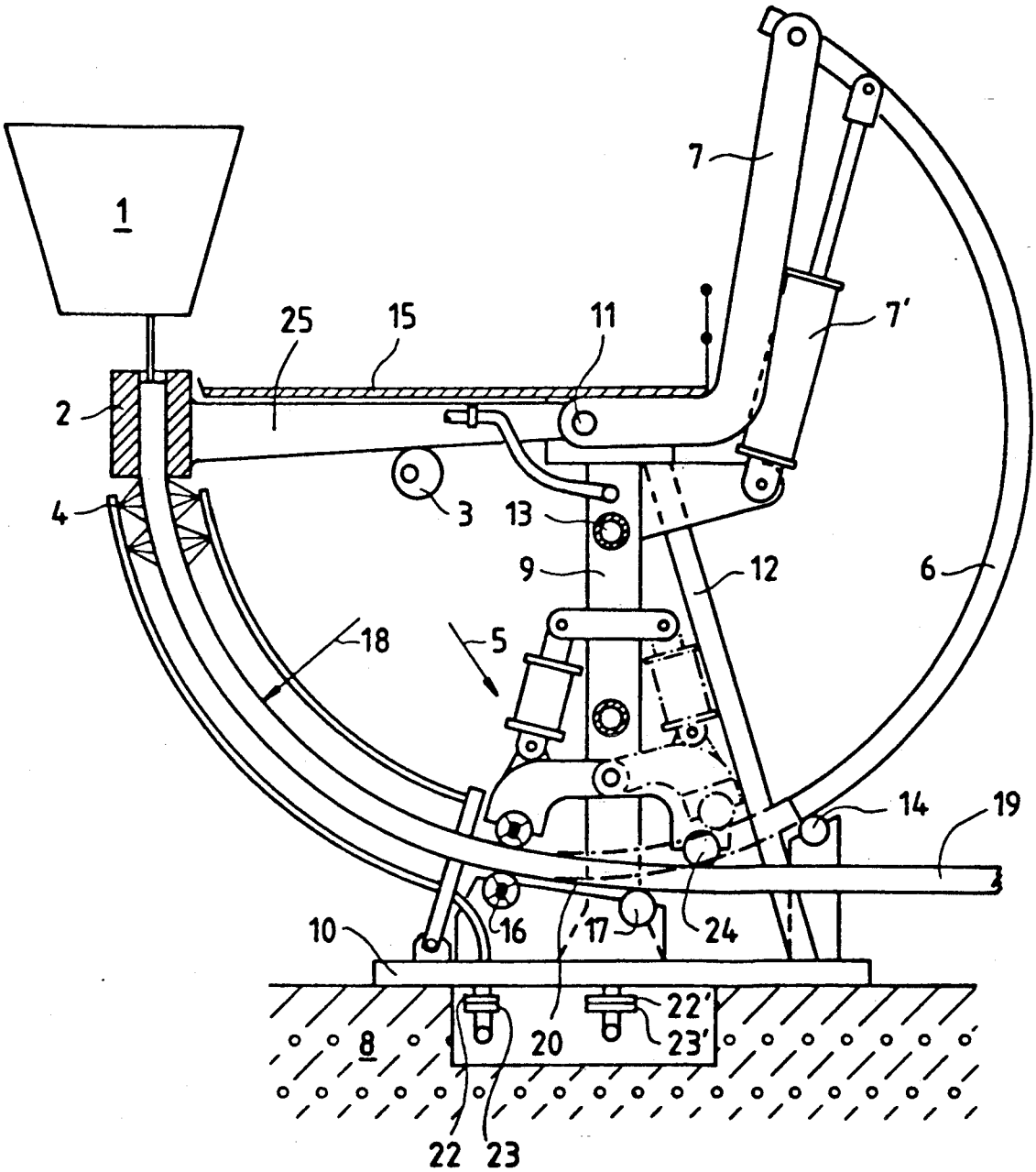
1
2
3
4
5
6
7
7'
8
9
10
11
12
13
14
15
16
17
18
19
20
22
22'
23
23'
24
25

MODULAR CONTINUOUS CASTING APPARATUS

This application is a continuation of application Ser. No. 07/513,805, filed Apr. 24, 1990, abandoned.

BACKGROUND OF THE INVENTION

The invention relates generally to continuous casting.

More particularly, the invention relates to a continuous casting apparatus, especially an apparatus for the continuous casting of steel.

One type of continuous casting apparatus is the curved-mold apparatus. This apparatus includes a reciprocable continuous casting mold having a curved casting passage and a secondary cooling unit which is designed to cool a continuously cast strand issuing from the mold. The apparatus further includes a withdrawal-and-straightening unit for the strand, a rigid dummy bar and a shifting mechanism designed to guide and move the dummy bar between a storage position and an operative position.

A curved-mold continuous casting apparatus for steel is supplied with molten steel by means of a vertical inlet or an inlet which is slightly inclined to the vertical. The resulting strand is guided along a curved path having an arc length of approximately 90 degrees and is subsequently straightened. As a rule, a horizontal strand removal mechanism is disposed downstream of the straightening unit.

The radius of the curved path in a continuous casting apparatus for steel billets can be 4 meters and greater. For blooms and slabs, the radius of the curved path is 8 to 12 meters. Continuous casting apparatus can be single-strand apparatus or multiple-strand apparatus capable of casting up to eight strands simultaneously.

A continuous casting apparatus of the type described above is provided with two or more walkable platforms or intermediate floors for operation and maintenance of the apparatus and is erected in the steel mill together with a steel support structure. The steel structure constitutes an integral part of the continuous casting apparatus and is used, by way of example, to suspend the mold and support the strand guide, withdrawal-and-straightening unit and dummy bar storage unit.

U.S. Pat. No. 3,344,844 discloses a continuous casting apparatus for steel having a rigid dummy bar in the form of a circular arc. This apparatus consists of a continuous casting mold, a secondary cooling unit, a withdrawal-and-straightening unit and a unit for guiding and moving the dummy bar. The device for guiding the dummy bar can simultaneously function as a means for parking the dummy bar. The mold is supported on the steel structure for the casting platform while the withdrawal-and-straightening unit is disposed on a foundation. The guide, storage and moving unit for the dummy bar is secured to columns of the casting platform structure. The curved strand guide between the mold and the withdrawal device is movably mounted on the foundation via a horizontally displaceable carriage.

Due to its bulkiness, such an apparatus cannot be transported in the assembled condition. As a rule, it is erected and aligned at the casting location. The steel structure, which is common to a plurality of strands, has a width based on the number of strands which the apparatus is designed to cast. The apparatus requires extended and expensive assembly and alignment work, and a change in the number of strands which can be cast is possible only by alteration of the casting platform structure.

SUMMARY OF THE INVENTION

It is an object of the invention to provide a continuous casting apparatus which is designed so that major components thereof can be readily transported in assembled condition.

Another object of the invention is to provide a continuous casting apparatus which can be manufactured and installed relatively economically.

An additional object of the invention is to provide a continuous casting apparatus which makes it possible to reduce or eliminate alignment work at the casting location which is required to align a mold, strand guide, withdrawal-and-straightening unit and dummy bar guiding and storage unit relative to one another.

A further object of the invention is to provide a readily transportable, single-strand continuous casting unit containing major components of a continuous casting apparatus in assembled condition and designed so that a multiple-strand continuous casting apparatus with a preselected number of strands can be produced from a plurality of such units placed side-by-side.

It is also an object of the invention to provide a readily transportable continuous casting unit which contains major components of a continuous casting apparatus in assembled condition and can be inspected with relative ease so that a high degree of availability is obtainable.

Still another object of the invention is to provide a continuous casting apparatus for billets and plates which is designed so that major components thereof can be readily transported and placed on a foundation at the casting location in assembled condition.

A concomitant object of the invention is to provide a method which enables erection of a continuous casting apparatus to be simplified.

The preceding objects, as well as others which will become apparent as the description proceeds, are achieved by the invention.

One aspect of the invention resides in a curved-mold continuous casting apparatus, particularly an apparatus for the continuous casting of steel. The apparatus comprises a reciprocable or oscillatory continuous casting mold having a curved casting passage and a guide adapted to guide the mold for reciprocation. A cooling unit is disposed downstream of the mold and serves to cool a curved, continuously cast strand exiting the mold. A first mechanism functions to withdraw the strand from the mold and at least partially straighten the strand. The apparatus further comprises a substantially rigid dummy bar and a second mechanism adapted to guide and move the dummy bar between a storage position and an operative position. The apparatus additionally comprises means for holding the mold, mold guide, first mechanism, dummy bar and second mechanism in assembled condition and in alignment for casting, and the holding means, mold, mold guide, first mechanism, dummy bar and second mechanism together at least in part constitute a self-supporting, transportable module.

The module is preferably a single-strand module, that is, a module capable of casting only one strand at a time.

By virtue of the novel structural concept, a continuous casting apparatus in accordance with the invention, or at least major components of the apparatus, can be transported in the assembled condition required for the mill or plant. The withdrawal-and-straightening mechanism may include drive rollers and the dummy bar with its guiding-and-moving mechanism may be positioned between the mold and the drive rollers so that the dummy bar and such mechanism do not take up additional space during transport. For a multiple-strand continuous casting apparatus, an appropriate number of modules according to the invention may be placed side-by-side on a prepared foundation and affixed by screwing, for example. The guiding-and-moving mechanism may include a device for guiding the dummy bar and, upon erection of the apparatus, it is no longer necessary to effect relative alignment of the mold, dummy bar guiding device and withdrawal-and-straightening mechanism. If the apparatus is provided with a strand guide, it is similarly unnecessary to align the mold, strand guide, withdrawal-and-straightening mechanism and dummy bar guiding device relative to one another during erection. The modular construction can be carried out very economically and inspection costs, as well as parts replacement costs, can be reduced.

In accordance with one embodiment of the invention, the module includes a support which can be affixed to a foundation, and the mold, mold guide, withdrawal-and-straightening mechanism, dummy bar and guiding-and-moving mechanism for the dummy bar are articulated or otherwise secured to the support. The support can have many different designs It is particularly advantageous for the support to be in the form of a stand having a pair of legs at either side which are connected to a bedplate or the like.

According to another favorable embodiment, the mold guide and the dummy bar guiding device can be pivotable about a common axis.

The curved mold may be disposed at different locations along a circular arc and the dummy bar may be curved in such a manner as to permit the latter to travel on this arc. The casting passage of the mold has an inlet section for the molten material to be cast and the inlet section can have a vertical orientation or can be inclined. The teeming characteristics are particularly good when the inlet section is vertically oriented. Such an orientation requires the rigid, curved dummy bar to have an arc length of 110 to 130 degrees.

The dummy bar can be guided and parked along a roller cage and can be moved by means of a pair of drive rollers. However, in accordance with a further advantageous embodiment of the invention, the guiding-and-moving mechanism for the dummy bar comprises a driven pivotable lever which is articulated to the dummy bar and remains articulated thereto in the parked or storage position of the dummy bar as well as in the operative or casting position of the dummy bar, that is, the position assumed by the dummy bar at the beginning of a casting procedure.

The pivotable lever can be angled so as to define two arms which make an angle of 90 degrees to 150 degrees with one another. One of the arms may be shorter than the other and the ratio of the length of the shorter arm to that of the longer arm may be approximately 1:2. The shorter arm may be pivotally mounted on the pivot axis of the lever while the longer arm is articulated to the dummy bar. This construction allows the casting platform to be enlarged.

When the radius of the casting passage in the mold, i.e., the casting radius, is 3.5 meters or less, the bending stress in the strand during straightening, or the bending stress in the solidified shell of the strand if the core is still molten, becomes relatively large. This can lead to cracks, particularly at the corners of the strand. To prevent such defects in the strand, the withdrawal-and-straightening mechanism may comprise a multipoint straightener, that is, a straightener which straightens the strand stepwise. Further improvement and simplification of the apparatus can, however, be achieved when the withdrawal-and-straightening mechanism is provided with a straightening segment designed to continuously straighten the strand from the curved configuration in which the radius of the strand equals the casting radius. Strands having a radius of curvature between 1.5 meters and 3.5 meters can be straightened with such a withdrawal-and-straightening mechanism while maintaining good strand quality. It is preferred for the casting radius, and hence the radius of the strand, to be 2.5 meters.

The module according to the invention may be provided with conduits for fluids such as mold cooling water, mold lubricant, secondary cooling water, protective gas, etc. The time required to install an individual module may be shortened, particularly if repairs are not to be made with the module in casting position, by equipping the support with coupling elements which can mate with cooperating coupling elements on respective fluid supply lines when the module is placed in casting position.

Individual modules can be rapidly added to and removed from the continuous casting apparatus in order to adapt the apparatus to different product requirements. It is also possible to adapt to new operating requirements by a conversion of the apparatus such as, for example, division of a 6-strand apparatus into two 3-strand apparatuses.

The novel features which are considered as characteristic of the invention are set forth in particular in the appended claims. The improved continuous casting apparatus itself, however, both as to its construction and its mode of operation, together with additional features and advantages thereof, will be best understood upon perusal of the following detailed description of certain specific embodiments when read in conjunction with the accompanying drawing.

BRIEF DESCRIPTION OF THE DRAWING

The single FIGURE is a partly sectional side view of a continuous casting apparatus in accordance with the invention.

DESCRIPTION OF THE PREFERRED EMBODIMENTS

Referring to the sole FIGURE, a curved-mold continuous casting apparatus is illustrated. The continuous casting apparatus is here assumed to be designed for the casting of metal, particularly steel.

Molten steel is teemed from a tundish 1 into a reciprocable or oscillatory continuous casting mold 2. The mold 2 is cooled in a conventional manner and is provided with an open-ended, curved casting passage having a predetermined radius constituting the casting radius. A schematically illustrated eccentric 3 functions as a drive which oscillates the mold 2. Downstream of the mold 2 as considered in the casting direction, i.e., in a direction from the upper or inlet end of the mold 2 to the lower or outlet end of the mold 2, is a secondary cooling unit 4 which, in turn, is followed by a withdrawal-and-straightening unit or mechanism 5. The apparatus further includes a rigid, curved dummy bar 6 having a radius equal to the casting radius, and a guiding-and-moving unit or mechanism 7,7' which serves to shift the dummy bar 6 between two terminal positions. One of these is a parked or storage position shown in the drawing while the other is an operative or casting position which the dummy bar 6 assumes preparatory to the start of a casting procedure. In the operative position, the lower end of the dummy bar 6 as seen in the drawing closes the lower end of the mold 2.

The continuous casting apparatus includes one or more, and preferably 2 to 8, self-supporting, single-strand, transportable modules arranged side-by-side. Only one such module is seen in the drawing. The module comprises the mold 2, a guide arm 25 which guides the mold 2 for oscillation, the withdrawal-and-straightening unit 5, the rigid dummy bar 6 and the guiding-and-moving unit 7,7'. The module further comprises a support, and the support includes a stand as well as a bedplate or a frame 10 which is secured to the stand and carries the same. The bedplate 10 rests on and is affixed to a foundation 8 so that the stand is connected to the foundation 8 via the bedplate 10. The stand includes two spaced, similar columns 9 of which one is shown in the drawing and the other is located in front of the plane of the drawing. The columns 9, which are secured to the bedplate 10, are connected to one another by transverse beams 13. The stand additionally includes a pair of inclined supporting legs 12 which are again affixed to the bedplate 10 and the stand thus constitutes a four-legged stand. One of the columns 9 and one of the supporting legs 12 is located at either end of the stand.

The mold 2, mold oscillation guide arm 25, withdrawal-and-straightening unit 5, dummy bar 6 and guiding-and-moving unit 7,7' are articulated or otherwise connected to at least one of the columns 9. The secondary cooling unit 4, which here consists only of coolant conduits and spray nozzles, is disposed on the bedplate 10 as is a guide roller 14 for the dummy bar 6.

A pivot 11 in the form of a bolt serves to pivotally mount the mold guide arm 25 on one or both of the columns 9. The guiding-and-moving unit 7,7' for the dummy bar 6 includes a guiding device 7 which is constituted by a pivotable lever. Similarly to the mold guide arm 25, the lever 7 is pivotally mounted on one or both of the columns 9 by means of the pivot 11 so that the guide arm 25 and the lever 7 are pivotable on a common axis. The lever 7 is also articulated to the dummy bar 6 and remains articulated to the latter as the dummy bar 6 travels between its storage position and its operative position. Movement of the dummy bar 6 between the operative and storage positions is effected by means of a drive which constitutes part of the guiding-and-moving unit 7,7' and is here in the form of a piston-and-cylinder unit 7'.

The means, such as the bolt 11, serving to mount the mold 2, mold guide arm 25, secondary cooling unit 4, withdrawal-and-straightening unit 5, dummy bar 6 and guiding-and-moving unit 7,7' on the support 9,10,12,13, together with the support, constitutes a holding means which holds the mold 2, guide arm 25, secondary cooling unit 4, withdrawal-and-straightening unit 5, dummy bar 6 and guiding-and-moving unit 7,7' in assembled condition and in alignment for casting. The holding means, mold 2, guide arm 25, secondary cooling unit 4, withdrawal-and-straightening unit 5, dummy bar 6 and guiding-and-moving unit 7,7' all constitute part of the self-supporting, transportable module. This module can be installed at the casting location on the prepared foundation 8 in final assembled condition and can likewise be removed from the foundation 8 and the casting location in such condition. Installation and removal of the module can be carried out by means of a crane, for example.

The dummy bar 6 preferably has an arc length of 110 to 130 degrees. In the illustrated embodiment, the arc length is 130 degrees.

The pivotable lever 7 is angled, that is, includes two arms which do not lie on a straight line. One of the arms is shorter than the other and the ratio of the length of the shorter arm to the length of the longer arm is approximately 1:2. The shorter arm is articulated to the pivot 11 while the longer arm is articulated to the dummy bar 6.

A casting platform 15 for operating personnel is located above the pivot 11. It is readily seen how the size of the casting platform can be influenced by the design of the angled lever 7.

The withdrawal-and-straightening unit 5 includes a pair of driven rollers 16 as well as an idler roller 17 and a straightening roller 24. A curved, continuously cast strand 19 issuing from the mold 2 and having a radius of curvature equal to the casting radius 18 travels along a transition curve 20 and is straightened between the driven rollers 16 and the idler roller 17. Downstream of the idler roller 17, the strand 19 moves along a straight path which is preferably horizontal. The withdrawal-and-straightening unit 5 may include a multipoint straightener or straightening span in which case one or more intermediate rollers are interposed between the driven rollers 16 and the idler roller 17. The strand 19 is then straightened stepwise and the transition curve 20 takes the form of a multipoint or discontinuous straightening curve. Alternatively, as shown, no intermediate rollers are provided between the driven rollers 16 and the idler roller 17. Here, the transition curve 20 constitutes a continuous straightening span along which the strand 19 is straightened continuously.

The casting radius can lie between 1.5 meters and 3.5 meters and is advantageously 2.5 meters. As the casting radius decreases, it becomes increasingly important to provide a continuous straightening span of appropriate length which is designed to permit slow straightening of the strand 19. The strain rate as expressed in percent elongation per unit length of the straightening span should not exceed a specified value.

The columns 9 of the stand and other components of the support 9,10,12,13 can be provided with conduits for fluids such as mold cooling water, secondary cooling water, mold lubricant, protective gas, and so on. These conduits can, in turn, be constructed with coupling elements 22,22' which are complementary to respective coupling elements 23,23' of fluid supply lines and can mate with the coupling elements 23,23' when the module is placed in casting position.

The dash-and-dot lines in the drawing show the position of the straightening roller 24 of the withdrawal-and-straightening unit 5, as well as the position of the strand 19, preparatory to uncoupling of the dummy bar 6 from the dummy bar head of the strand 19 and prior to arrival of the dummy bar 6 at the storage position illustrated in the drawing. After the uncoupling procedure, the straightening roller 24 assumes the position shown in full lines.

When the module is to be transported, the dummy bar 6 can be shifted so that it extends into the mold 2 and can then be clamped. This allows the volume of the module to be substantially reduced for transport.

The continuous casting apparatus of the invention is particularly well-suited for the casting of billets and plates.

Without further analysis, the foregoing will so fully reveal the gist of the present invention that others can, by applying current knowledge, readily adapt it for various applications without omitting features that, from the standpoint of prior art fairly constitute essential characteristics of the generic and specific aspects of our contribution to the art and, therefore, such adaptations should and are intended to be comprehended within the meaning and range of equivalence of the appended claims.

We claim:

1. A curved-mold continuous casting apparatus, comprising a reciprocable continuous casting mold having a curved casting passage; a guide arranged to guide said mold for reciprocation; a cooling unit for cooling a curved, continuously cast strand exiting said mold; a first mechanism for withdrawing the strand from said mold and at least partially straightening the strand; a substantially rigid dummy bar; a second mechanism arranged to guide and move said dummy bar between a storage position and an operative position; and means for holding said mold, guide, first mechanism, dummy bar and second mechanism in assembled condition and in alignment for casting, said holding means, mold, guide, first mechanism, dummy bar and second mechanism together constituting a self-supporting, transportable module and said holding means defining a common pivot axis for at least three of said mold, guide, dummy bar and second mechanism.

2. The apparatus of claim 1, wherein said module is a single-strand module.

3. The apparatus of claim 1, wherein said holding means comprises a support designed to be secured to a foundation, and means for mounting said mold, guide, first mechanism, dummy bar and second mechanism on said support.

4. The apparatus of claim 3, wherein said support comprises a stand having opposite ends and a bedplate designed to be placed on a foundation, said stand having a pair of legs at each of said ends connected to said bedplate.

5. The apparatus of claim 1, wherein said second mechanism comprises a guide for said dummy bar, said guides being pivotable on said common axis.

6. The apparatus of claim 1, wherein said dummy bar is curved and has an arc length of about 110 to about 130 degrees.

7. The apparatus of claim 1, wherein said second mechanism comprises a driven, pivotable lever which is articulated to said dummy bar in both of said positions.

8. The apparatus of claim 7, wherein said lever is angled and includes a shorter first arm which is articulated to said holding means and a longer second arm which is articulated to said dummy bar, the ratio of the length of said first arm to the length of said second arm being approximately 1:2.

9. The apparatus of claim 1, wherein said first mechanism is designed to straighten the strand stepwise.

10. The apparatus of claim 1, wherein said first mechanism is designed to straighten the strand continuously.

11. The apparatus of claim 1, wherein said passage has a radius of curvature between about 1.5 meters and about 3.5 meters.

12. The apparatus of claim 11, wherein said radius is about 2.5 meters.

13. The apparatus of claim 1, wherein said holding means comprises conduits and coupling elements for connecting said conduits to fluid sources.

14. The apparatus of claim 13, wherein said conduits include a first conduit for supplying cooling water to said mold, a second conduit for supplying cooling water to said cooling unit, a third conduit for admitting a lubricant into said casting passage and a fourth conduit for protective gas.

15. The apparatus of claim 1, wherein said module is a single-strand module; and further comprising at least one similar additional module, said modules being arrangeable side-by-side so as to form a multiple-strand casting unit.

16. The apparatus of claim 15, wherein the number of additional modules is sufficient to form an eight-strand casting unit.

* * * * *